US005760487A

United States Patent [19]

Kimura et al.

[11] Patent Number: 5,760,487

[45] Date of Patent: Jun. 2, 1998

[54] COAXIAL ENGINE STARTER SYSTEM

[75] Inventors: Eiichi Kimura, Gunma-ken; Shinichi Nagashima, Tochigi-ken; Mitsuhiro Kogure, Gunma-ken; Michio Okada, Gunma-ken; Koji Nara, Gunma-ken, all of Japan

[73] Assignee: Mitsuba Corporation, Gunma-Ken, Japan

[21] Appl. No.: 653,873

[22] Filed: May 28, 1996

[30] Foreign Application Priority Data

May 29, 1995 [JP] Japan ..... 7-153816
May 29, 1995 [JP] Japan ..... 7-153818

[51] Int. Cl.[6] ..... F02N 11/00

[52] U.S. Cl. ..... 290/48; 290/38 R; 74/7 R; 74/7 E

[58] Field of Search ..... 290/38 R, 38 A, 290/38 B, 38 C, 48; 74/7 R, 6, 7 A, 7 B, 7 C, 7 E

[56] References Cited

U.S. PATENT DOCUMENTS

| | | | |
|---|---|---|---|
| 3,232,123 | 2/1966 | Wheatley | 74/7 R |
| 5,023,466 | 6/1991 | Isozumi | 290/48 |
| 5,118,960 | 6/1992 | Sasamoto et al. | 290/48 |
| 5,528,084 | 6/1996 | Shiga et al. | 290/38 R |

FOREIGN PATENT DOCUMENTS 63-90666 4/1988 Japan .

*Primary Examiner*—Steven L. Stephan
*Assistant Examiner*—Nicholas Ponomarenko
*Attorney, Agent, or Firm*—Skjerven Morrill MacPherson Franklin & Friel LLP; Thomas S. MacDonald

[57] ABSTRACT

In a coaxial engine starter comprising a pinion connected to the output shaft which is driven by an electric motor, via a helical spline, a switch unit for selectively closing a power supply line to the electric motor, and a solenoid device consisting of an annular armature and an annular energization coil surrounding the output shaft to axially drive the pinion and a moveable contact of the switch unit in the axial direction, the energization coil is disposed between the electric motor and the pinion with a commutator of the electric motor facing the energization coil, and a pigtail for one of the brushes is directly connected to the moveable contact. Also, the contacts of the switch unit are placed between a pair of adjacent brushes of the commutator.

In particular, by separating the part of the armature for driving the moveable contact from the part of the armature for driving the pinion, the stroke of the moveable contact can be minimized, and the stress acing upon the connecting part of the pigtail upon movement of the contact can be minimized.

14 Claims, 3 Drawing Sheets

COAXIAL ENGINE STARTER SYSTEM

RELATED APPLICATIONS

This application relates to U.S. application Ser. Nos. 08/654,658 filed May 29, 1996 and 08/654,065 filed May 28, 1996, each assigned to the same assignee as subject application.

TECHNICAL FIELD

The present invention relates to an engine starter system, and in particular to an engine starter system having an output shaft, an electric motor, and a solenoid device all in a coaxial arrangement.

BACKGROUND OF THE INVENTION

In conventional engine starters, it has been customary to arrange an output shaft, which carries an axially slidable pinion adapted to mesh with a ring gear, and a solenoid device for axially driving the pinion, in a mutually parallel relationship. However, because such bi-axial engine starters have a solenoid device which extends radially from the electric motor, and therefore inevitably have a substantial radial dimension, there have been severe restrictions in ensuring a sufficient space for mounting the engine starter.

To overcome such a problem, in Japanese patent laid-open publications (kokai) Nos. 1-1208564 and 63-90666, it was proposed to provide coaxial starters having an annular solenoid device surrounding the output shaft.

However, in such a coaxial type engine starter, the solenoid device for axially driving the pinion also serves as the device for driving the electromagnetic switch unit which selectively closes and opens the electric power line leading to the electric motor. Therefore, the electric motor and the solenoid device are placed in parallel with each other, and the connecting terminals for the electromagnetic switch unit and the commutator of the electric motor are placed on a same axial side with the aim of minimizing the length of the electric lines connected between them.

According to the coaxial engine starter disclosed in Japanese patent laid-open publication No. 1-208564, as it was constructed simply by placing an electric motor and a solenoid device for a conventional bi-axial engine starter into a tandem relationship, the axial dimension of the engine starter was significant, and an external wiring was necessary because of the long axial distance between the power terminals of the electric motor and the connecting terminals of the electromagnetic switch unit. According to the coaxial engine starter disclosed in Japanese patent laid-open publication No 63-90666, even though no external wiring is necessary because the electromagnetic switch unit and the commutator are place adjacent to each other, the transmission member for transmitting the displacement of the armature to the pinion tends to be excessive because the solenoid device is placed at an axial end remote from the pinion, and this necessitated a highly complex design arrangement.

Also, in conventional engine starters such as those disclosed in the above mentioned Japanese patent publications, it has been customary to connect the connecting terminals of a battery and the connecting terminal of the pigtails for the brushes to a pair of fixed contacts, and selectively close and open the connection between the fixed contacts with a moveable contact which is connected to an armature of the solenoid device for driving the pinion.

However, according to such a conventional switch mechanism, because a pair of fixed contacts were required for connection with the battery and the pigtails, respectively, and not only a relatively large number of component parts were required, but also there was a great difficulty in reducing radial and axial dimensions because of space requirements.

BRIEF SUMMARY OF THE INVENTION

In view of such problems of the prior art, a primary object of the present invention is to provide a compact coaxial engine starter in which the rotor shaft of the electric motor, the slidable shaft of the pinion, and the solenoid device for driving the pinion and the switch are arranged in a coaxial relationship.

A second object of the present invention is to provide a coaxial engine which allows the number of component parts related to the switch to be reduced, and the axial and radial dimensions to be reduced.

A third object of the present invention is to provide a coaxial engine which allows any external wiring to be eliminated and the axial dimension of the starter to be minimize without complicating its structure.

A fourth object of the present invention is to provide a coaxial engine which is economical to manufacture and durable in use.

According to the present invention, these and other objects can be accomplished by providing an engine starter, comprising: an electric motor mounted to a casing; an output shaft disposed in the casing coaxially to the electric motor in a power transmitting relationship; a pinion for driving a ring gear of an engine which is connected to the output shaft via spline means in a coaxial relationship; a switch unit attached to the casing including a fixed contact and a moveable contact for selectively closing a power supply line leading to the electric motor; and a solenoid device consisting of an annular armature and an annular energization coil surrounding the output shaft to axially drive the pinion and a moveable contact of the switch unit in the axial direction; wherein the energization coil is disposed between the electric motor and the pinion, and a commutator of the electric motor is placed adjacent the energization coil.

According to this structure, because the commutator and the contacts of the switch are placed adjacent with each other, the wiring between the brushes and the switch can be simplified.

In particular, a pigtail for one of brushes of the commutator may be directly connected to the moveable contact. Because the connecting terminal of the battery and the pigtail for one of the brushes can be selectively connected with each other by using a single fixed contact and a single moving contact, the number of component parts related to the switch can be reduced. In particular, by separating the part of the armature for driving the moveable contact from the part of the armature for driving the pinion, the stroke of the moveable contact can be minimized, and the stress acing upon the connecting part of the pigtail upon movement of the contact can be minimized.

For instance, the armature may consist of a first part which is connected to the moveable contact and a second part which is connected to the pinion, the first and second parts being coaxially nested with each other so as to be axially moveable relative to each other. In particular, if lost motion means is interposed in a path of force transmission between the armature and the moveable contact of the switch unit for allowing movement of the armature after the moveable contact has come into contact with the fixed contact, it is possible to reduce the axial length of the structure required for the actuation of the switch, and this contributes to the reduction in the overall axial length of the engine starter.

According to a preferred embodiment of the present invention, the contacts of the switch unit are placed between a pair of adjacent brushes of the commutator so that the axial dimension can be even further reduced.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1A:
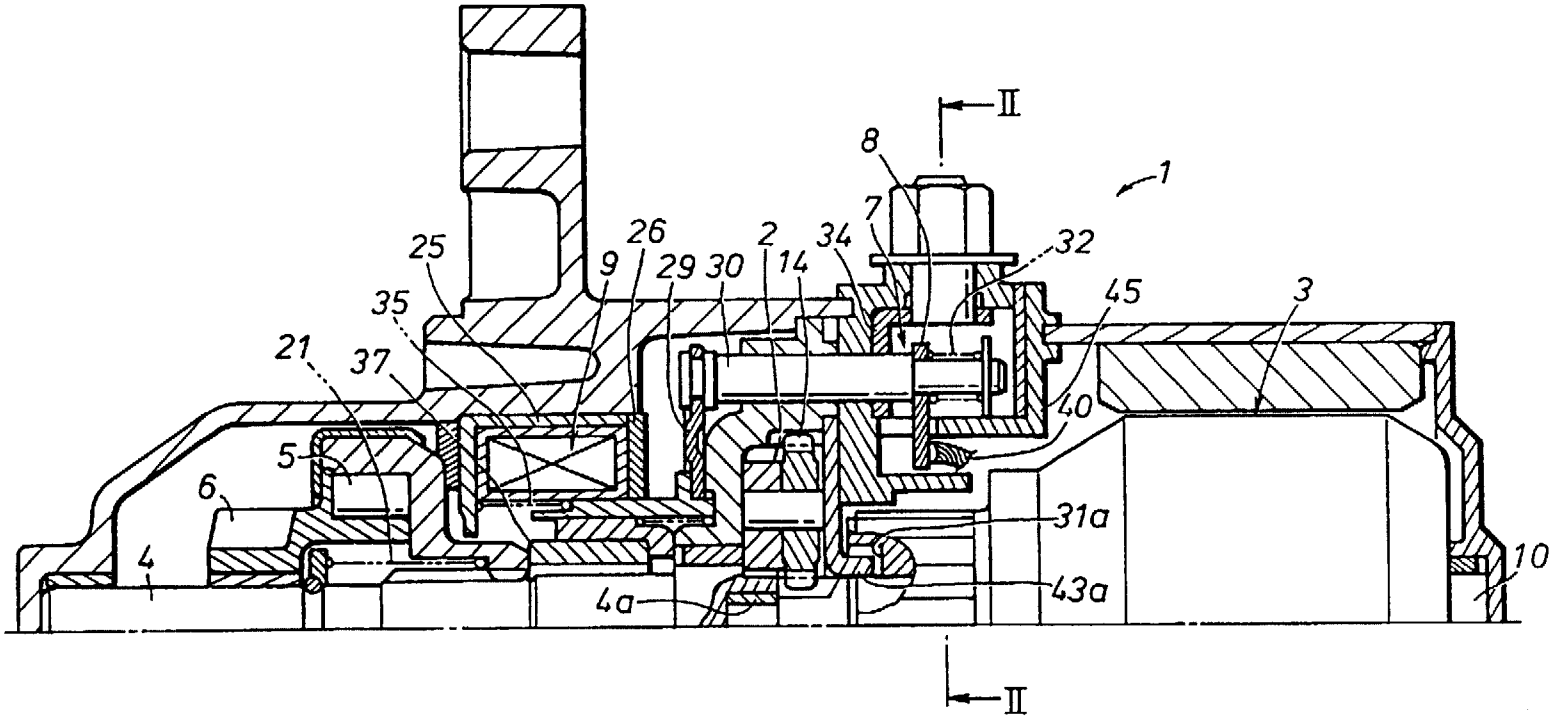
FIG. 1 is a sectional view of a first embodiment of the coaxial engine starter according to the present invention, the upper half of the drawing showing the rest condition of the starter while the lower half showing the operative condition of the engine starter.
Figure 1B:
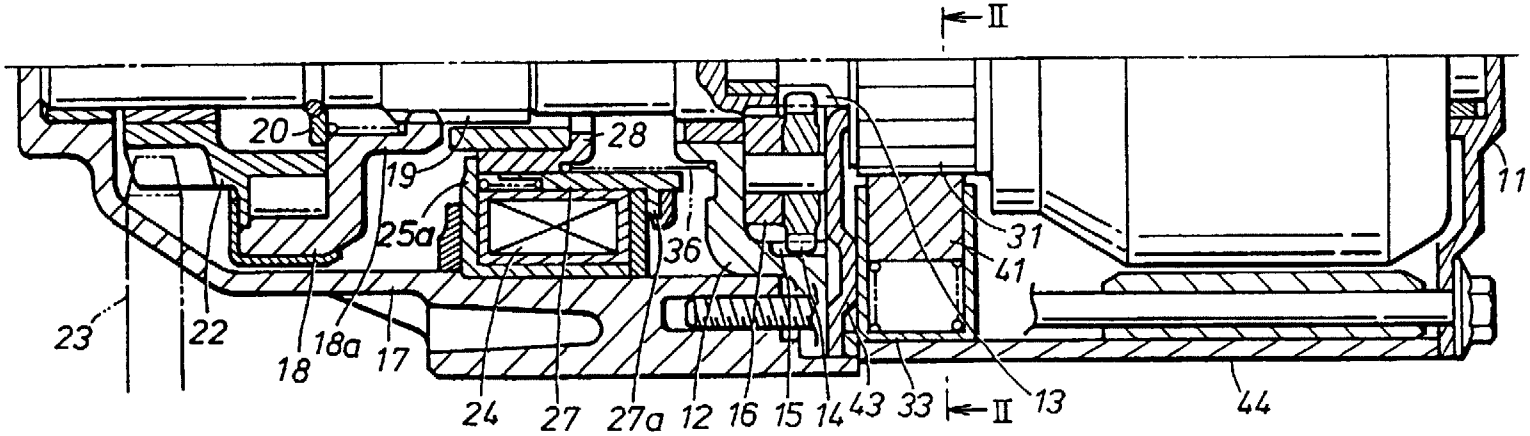

FIG. 1 generally illustrates an engine starter equipped with a reduction gear unit which is constructed according to the present invention, and the upper half of the drawing illustrates the starter at its inoperative state while the lower half of the drawing illustrates the starter at its operative state. This starter 1 produces a torque which is necessary for starting an internal combustion engine, and comprises an electric motor 3 equipped with a planetary gear reduction gear unit 2, an output shaft 4 connected to the electric motor 3 via the reduction gear unit 2, a one-way roller clutch 5 and a pinion 6 which are slidably mounted on the output shaft 4, a switch unit 7 for selectively opening and closing the electric power line 40 leading to the electric motor 3, and a solenoid device 9 for axially moving a moveable contact 8 of the switch unit 7 as well as the pinion 6.

The electric motor 3 consists of a known commutator type DC electric motor, and its rotor shaft 10 is pivotally supported a central recess of a bottom plate 11 at its right end, and pivotally supported in a central recess 4*a* provided in a right end surface of the output shaft 4, which is coaxially disposed with respect to the rotor shaft 10, at its left end. The bottom plate 11 closes a right end of a cylindrical motor casing 44.

The reduction gear unit 2 is provided in a recess defined on the inner surface of the top plate 12 of the electric motor 3 which closes the left end of the motor casing 44. The reduction gear unit 2 comprises a sun gear 13 which is formed in a part of the rotor shaft 10 adjacent to the output shaft 4, a plurality of planetary gears 14 meshing with the sun gear 13, and an internal teeth ring gear 15 formed along the outer periphery of the recess defined on the inner surface of the top plate 12 to mesh with the planetary gears 14. A support plate 16 supporting the planetary gears 14 is attached, by press fitting, to the right end of the output shaft 4 which is pivotally supported in a central opening of the top plate 12.

To the top plate 12 is attached a pinion housing 17 which also serves as a securing bracket for mounting the starter to the engine. The left end of the output shaft 4 is pivotally supported in a central recess defined on the inner surface of the left wall of the pinion housing 17.

The outer circumferential surface of a middle part of the output shaft 4 engages the inner circumferential surface of a clutch outer member 18 of the one-way roller clutch 5 via a helical spline 19. The clutch outer member 18 is normally urged to the right by a return spring 21 interposed between an annular shoulder defined in a cylindrical sleeve 18*a* extending from the clutch outer member 18 toward the electric motor 3 and a stopper plate 20 secured to a left end portion of the output shaft 4. The right extreme end of the cylindrical sleeve 18*a* engages with the helical spline 19 formed in the output shaft. The return spring 21 is received in an annular gap defined between the inner circumferential surface of the sleeve 18*a* extending from the clutch outer member 18 and the outer circumferential surface of the output shaft 4. By so doing, the return spring 21 is disposed inside the one-way roller clutch 5, and the axial dimension of the assembly can be minimized.

The clutch outer member 18 engages a clutch inner member 22 of the one-way roller clutch 5 in an axially fast but rotationally free relationship (which depends on the direction of relative rotation). The outer circumferential surface of the left end of the clutch inner member 22 is integrally formed with the aforementioned pinion 6 which meshes with the ring gear 23 of the engine to drive the same. The clutch inner member 22 integrally formed with the pinion 6 is fitted on the left end of the output shaft 4 in a both rotationally and axially free relationship.

In an intermediate part of the pinion housing 17 is secured an energization coil 24 which surrounds the output shaft 4 made of non-magnetic material such as stainless steel. The energization coil 24 is surrounded by a yoke defined by a cup-shaped holder 25 having an internal flange 25*a* surrounding the output shaft 4 and an annular disk 26. In a gap defined between the inner circumferential surface of the energization coil 24 and the outer circumferential surface of the output shaft 4 is disposed an armature outer member 27 and an armature inner member 28, both made of ferromagnetic material, in a mutually coaxially nested and axially slidable relationship. The left ends of the armature members 27 and 28 oppose the axially inner surface of a central part of the internal flange 25*a* of the holder 25, and the central part of the internal flange 25*a* serves as a magnetic pole for the armature members 27 and 28. By thus making the output shaft 4 received in the solenoid device 9 from non-magnetic material, the magnetic path is concentrated in the armature, and the air gap between the armature and the output shaft can be virtually eliminated so that the radial dimension of the solenoid device 9 can be minimized.

The first part of the armature or the armature outer member 27 is connected at its right end to a connecting plate 29, and, via a connecting rod 30 passing through the top plate 12 of the electric motor 3, to the moveable contact 8 of the switch unit 7 placed adjacent the commutator 31 of the electric motor 3. The moveable contact 8 is mounted to the connecting rod 30 in an axially moveable manner, and is supported by a coil spring 32 in a floating relationship so as to be selectively engaged to and disengaged from a fixed contact 34 of the switch unit 7 which is fixedly secured to a brush stay 33 provided around the commutator 31. In other words, the moveable contact 8 is linked to the armature outer member 27 via a lost motion mechanism. The armature outer member 27 is always urged to the right by a return spring 35 interposed between the armature outer member 27 and the internal flange 25*a* provided in the holder 25 of the energization coil 24, but is normally at its neutral or rest position separating the moveable and fixed contacts from each other.

The second part of the armature or the armature inner member 28 is always urged to the left with respect to the top plate 12 by a coil spring 36 which is weaker that the return spring 21 of the clutch outer member 18. The armature inner member 28 is connected to a shifter member 37 made of non-magnetic material having a left end engaging the right end of the clutch inner member 22.

By thus separating the armature into the armature inner member 27 for driving the moveable contact 8 and the armature outer member 28 for driving the pinion 6 which are allowed to move individually, no space is needed in axially front and rear portions of the energization coil 24, and the axial dimension of the solenoid device can be minimized.

A gap is defined between the opposing end surfaces of the clutch outer member 18 and the shifter member 37 so as to prevent them from contacting each other when the pinion 6 is fully meshed with the ring gear 23. This gap is preferably no more than one half the meshing overlap between the pinion 6 and the ring gear 23.

The energization coil 24 is electrically connected to an ignition switch not shown in the drawing via a connector 38 (see FIG. 2) provided in the switch unit 7.

Figure 2:
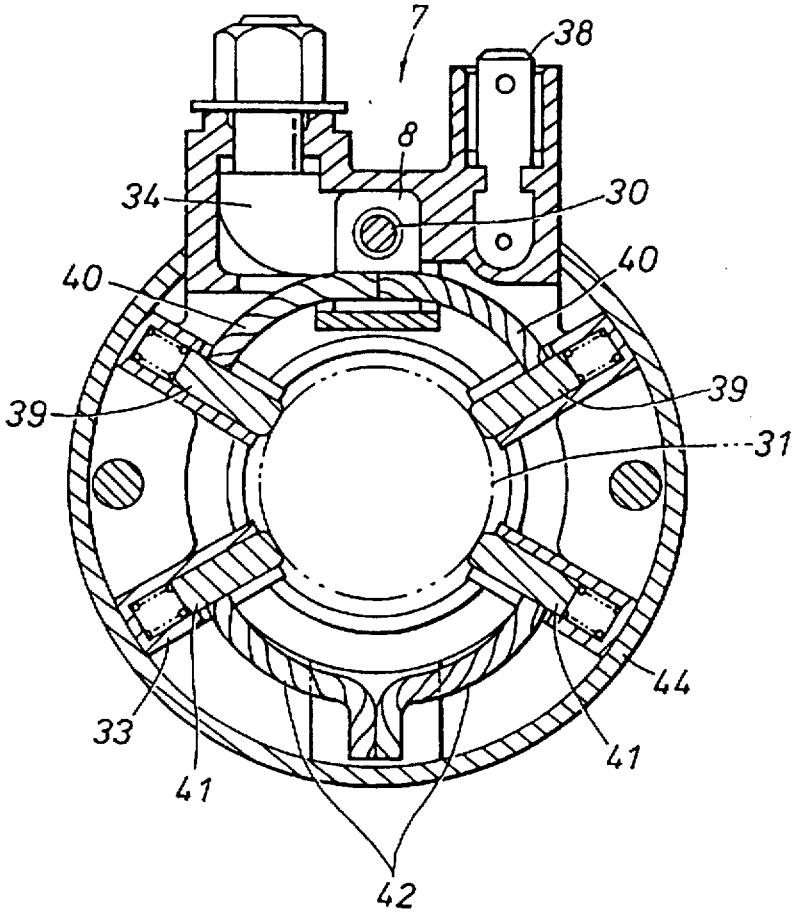
FIG. 2 is a sectional view taken along line II—II of FIG. 1.

The fixed contact 34 of the switch unit 7 is electrically connected to the positive terminal of a battery not shown in the drawings, and a pair of pigtails 40 connected to a pair of positive pole brushes 39 are attached to the fixed contact 34 by spot welding also as illustrated in FIG. 2. A pair of negative pole brushes 41 are provided in a line-symmetrically opposing positions with respect to the positive pole brushes 39. The pigtails 42 for these negative pole brushes 41 are connected to a center plate 43 which is described hereinafter, and is connected to the negative terminal of the battery via the pinion housing 17 and the vehicle body which is not shown in the drawings. The switch unit 7 is provided in a space flanked by the positive pole brushes 39. By so doing, the connecting terminals leading to the battery and the pigtails 40 of the positive brushes 39 can be selectively connected by the single moveable contact 8 and the single fixed contact 34 so that the number of component parts for the switch unit 7 can be reduced, and the dimensions in both radial and axial directions, can be reduced. The brushes 39 and 41 are supported in a known manner by a brush stay 33 which is made of electrically insulating material.

An annular metallic center plate 43 is interposed between the brush stay 33 and the top plate 12 to separate the reduction gear unit 2 from the electric motor 3. A central part of the center plate 43 is provided with a cylindrical portion **43*a* which projects toward the commutator 31 with its inner circumferential surface receiving the outer circumferential surface of the rotor shaft 10 defining a small gap therebetween. The free end of the cylindrical portion 43*a* is received in a recess 31*a* formed in an axial end surface of the commutator 31 to prevent grease from leaking out of the reduction gear unit 2 to the commutator 31**.

The switch unit 7 is located at a top part of the starter 1, and the contacts, or the fixed contact 34 secured to the brash stay 33 and the moveable contact 8, are covered by the brush stay 33 and a switch cover 45 to prevent any particulate foreign matters that may be produced from the brushes from getting into the switch unit 7.

Now the operation of the above described embodiment is described in the following. In the inoperative condition, because no electric current is supplied to the energization coil 24, the armature outer member 27 is at its rightmost condition under the spring force of the return spring 35, and the moveable contact 8 which is connected to the armature outer member 27 is spaced from the fixed contact 34. At the same time, the clutch outer member 18 which is urged by the return spring 21 is at its rightmost position along with the clutch inner member 22 which is integral with the pinion 6, the shifter member 37 and the armature inner member 28 with the result that the pinion 6 is disengaged from the ring gear 23.

When the ignition switch is turned to the engine start position, electric current is supplied to the energization coil 24 to magnetize the same. As a result, a magnetic path for conducting a magnetic flux is established in the armature inner and outer members 27 and 28 thereby moving the armature inner and outer members 27 and 28 to the left. The armature outer member 27, as it is closer to the central part (pole) of the internal flange **25*a* of the holder 25 than the armature inner member 28, moves before the armature inner member 28 does. As a result, the moveable contact 8 is moved to the left by the armature outer member 27 via the connecting plate 29 and connecting rod 30, and comes into contact with the fixed contact 34. This in turn causes the electric power of the battery to be supplied to the electric motor 3, and the rotor shaft 10 to be turned. Because the moveable contact 8 comes into contact with the fixed contact 34 before the armature outer member 27 moves its full stroke, and the moveable contact 8 is mounted on the connecting rod 30 in an axially floating relationship, the pressure of the coil spring 32 is applied between the two contacts 8 and 34. At this point, the armature outer member 27 comes to a stop with a certain gap defined between the left end surface of the armature outer member 27 and the central part of the internal flange 25*a* because of the presence of a stopper integrally formed at the right end of the armature outer member 27 as an external flange 27*a* comes into contact with the annular disk 26**.

As the rotor shaft 10 turns, this rotation is reduced in speed by the reduction gear unit 2, and is transmitted to the output shaft 4. Because of the inertia of the clutch outer member 18 which engages with the output shaft 4 via the helical spline 19, the axial force owing to the helical spline 19 is applied to the clutch outer member 18, causing it to move to the left. At the same time, the armature inner member 28, which is subjected to the leftward attractive force by the energization coil 24 and the pressure from the coil spring 36, starts moving to the left. This force is applied to the clutch outer member 18 as an axial force via the shifter member 37. In this case, it is preferable for the electric motor to start turning before the armature inner member 28 or the shifter member 37 comes into contact with the clutch outer member 28 in view of reducing the required output of the energization coil 24. However, it is within the purview of the present invention to appropriately and freely otherwise select the timing of the start of the rotation of the electric 3 and the subsequent actuation of the helical spline 19 in relation with the axial engagement between the shifter member 37 and the clutch outer member 28 depending on the output available from the energization coil 24.

This axial force pushes the clutch outer member 18 leftward against the biasing force of the return spring 21, and the pinion 6, which is integral with the clutch inner member 22 and is therefore integrally engaged with the clutch outer member 18, is also pushed leftward. Once the clutch outer member 18 engages with the stopper plate 20, and the pinion 6 comes into full mesh with the ring gear 23, the rotation of the output shaft 4 is transmitted to the ring gear 23, and starts the engine. At this point, the left end surface of the armature inner member 28 engages the central part of the internal flange **25*a* of the holder 25, and a small gap is defined between the left end surface of the shifter member 37 which has integrally moved with the armature inner member 28 and the clutch outer member 18. Because the armature inner member 28 receives a maximum attractive force of the energization coil 24 as it engages the central part of the internal flange 25***a* of the holder 25, even when the pinion 6 is subjected to a force which tends to disengage it from the ring gear 23, the rightward movement of the clutch outer member 18 is prevented by the shifter member 37, and the pinion 6 is prevented from dislodging from the ring gear 23.

The electric current that is required to keep the armature inner and outer members 27 and 28 stationary after they have moved the full stroke is substantially smaller than that required for starting the movement of the armature inner and outer members 27 and 28. In other words, by making use of the axial force owing to the helical spline 19 for starting the movement of the one-way roller clutch 5 including the pinion 6, the output requirement of the energization coil 24 can be reduced, and the size of the energization coil 24 can be accordingly reduced.

A gap is defined between the opposing end surfaces of the clutch outer member 18 and the shifter member 37, and this gap minimizes the time of contact between the clutch outer member 18 and the shifter member 37 so as to minimize the friction between them and hence the wear of the associated parts. Because this gap is sufficiently smaller than the meshing overlap between the pinion 6 and the ring gear 23 (for instance, no more than one half the overlap), any premature disengagement between them can be avoided.

Once the engine has started and the rotational speed of the engine exceeds that of the pinion 6, the pinion 6 will start turning freely by virtue of the one-way roller clutch 5 in the same manner as in the conventional engine starter.

When the supply of electric current to the energization coil 24 ceases, owing to the biasing force of the return spring 21 acting upon the clutch outer member 18 and the biasing force of the return spring 34 acting upon the armature outer member 27, the pinion 6 is disengaged from the ring gear 23 and the moveable contact 8 is separated from the fixed contact 32, thereby stopping the electric motor 3.

Thus, according to the present invention, the energization coil is disposed between the electric motor and the pinion, and a commutator of the electric motor is placed adjacent the energization coil.

Therefore, it is possible to directly connect a pigtail for one of the brushes to the moveable contact.

Conventionally, because a pair of fixed contacts were required for connection with the battery and the pigtail, respectively, the number of component parts related to the switch could not be reduced, and there was a great difficulty in reducing radial and axial dimensions because of space requirements. However, according to the preferred embodiment of the present invention, because the connecting terminal of the battery and the pigtail for the brushes can be selectively connected with each other by using a single fixed contact and a single moveable contact, the number of component parts related to the switch can be reduced, and radial and axial dimensions can be reduced. In particular, by using a separate part of the armature for driving the moveable contact, the stroke of the pigtail is minimized, and hence the stress acting upon the connecting portion for the pigtail can be minimized with the result that the durability of the pigtail can be ensured even though it is connected to the moveable contact.

Also, the contacts of the switch unit may be placed between a pair of adjacent brushes of the commutator.

Conventionally, because the terminals of the commutator of the electric motor and the terminals of the electromagnetic switch were axially remote from each other, an external wiring was necessary to connect them with each other. Also, because the solenoid device was remote from the pinion, it was necessary to use an extended transmission member to transmit the displacement of the armature to the pinion. However, as described above, according to the preferred embodiment of the present invention, because the terminals of the commutator of the electric motor and the terminals of the electromagnetic switch are placed adjacent to each other, the wiring between the brushes and the switch can be simplified. Also, because the solenoid device is placed adjacent to the pinion, the transmission member between them is not required to be long in length. Further, by placing the contacts between a pair of adjacent brushes, the axial dimension can be even further reduced. Therefore, the present invention can make a significant contribution in simplifying the overall structure of the engine starter and reducing its axial dimension.

Although the present invention has been described in terms of a specific embodiment thereof, it is possible to modify and alter details thereof without departing from the spirit of the present invention.

What we claim is:

1. An engine starter, comprising:

an electric motor mounted to a casing, and having a rotor shaft for producing an output torque;

an output shaft disposed in said casing coaxially to said electric motor in a power transmitting relationship via a planetary gear unit having an input end coupled with said rotor shaft and an output end coupled with said output shaft;

a pinion for driving a ring gear of an engine which is connected to said output shaft via spline means in a coaxial relationship;

a switch unit attached to said casing including a fixed contact and a moveable contact for selectively closing a power supply line leading to said electric motor; and a solenoid device comprising an annular armature and an annular energization coil surrounding said output shaft to axially drive said pinion and a moveable contact of said switch unit in the axial direction;

wherein a commutator of said electric motor is placed adjacent to both said energization coil and said switch unit, and said planetary gear unit separates said solenoid device from said commutator inside said casing.

2. An engine starter according to claim 1, wherein a pigtail for one of brushes of said commutator is directly connected to said moveable contact.

3. An engine starter according to claim 1, where said contacts of said switch unit are placed between a pair of adjacent brushes of said commutator.

4. An engine starter according to claim 1, further comprising lost motion means interposed in a path of force transmission between said armature and said moveable contact of said switch unit for allowing movement of said armature after said moveable contact has come into contact with said fixed contact.

5. An engine starter according to claim 2, wherein said armature consists of a first part which is connected to said moveable contact and a second part which is connected to said pinion, said first and second parts being coaxially nested with each other so as to be axially moveable relative to each other.

6. An engine starter according to claim 5, wherein said spline means consists of a helical spline.

7. An engine starter according to claim 1, wherein said planetary gear unit comprises a sun gear formed on said rotor shaft, a support plate rotatably carrying planetary gears meshing with said sun gear, and an internal teeth ring gear formed in a top plate secured to said casing in a coaxial relationship with said sun gear and meshing with said planetary gears, said support plate being coupled with said output shaft in a power transmitting relationship.

8. An engine starter according to claim 7, wherein a connecting rod extends axially and slidably through said top plate to transmit an actuating force of said solenoid device to said moveable contact of said switch unit.

9. An engine starter according to claim 7, wherein said sun gear and said planetary gears, and said support plate are substantially received in a recess defined on a side of said top plate facing said electric motor.

10. An engine starter according to claim 7, wherein a free end of said rotor shaft is pivotally supported in a central recess formed in an opposing end surface of said output shaft.

11. An engine starter, comprising:

an electric motor mounted to a casing, and having a rotor shaft for producing an output torque;

an output shaft disposed in said casing coaxially to said electric motor in a power transmitting relationship via a planetary gear unit having an input end coupled with said rotor shaft and an output end coupled with said output shaft;

a pinion for driving a ring gear of an engine which is connected to said output shaft via spline means in a coaxial relationship;

a switch unit attached to said casing including a fixed contact and a moveable contact for selectively closing a power supply line leading to said electric motor; and a solenoid device comprising an annular armature and an annular energization coil surrounding said output shaft to axially drive said pinion and a moveable contact of said switch unit in an axial direction;

wherein said planetary gear unit is disposed between said energization coil and said switch unit, and a connecting rod extends axially and slidably through a member carrying an internal teeth ring of said planetary gear unit to transmit an actuating force of said solenoid device to said moveable contact of said switch unit.

12. An engine starter according to claim 11, wherein said planetary gear unit further comprises a sun gear formed on said rotor shaft, a support plate rotatably carrying planetary gears meshing with both said sun gear and said internal teeth ring gear which is coaxial with said sun gear, said support plate being coupled with said output shaft in a power transmitting relationship.

13. An engine starter according to claim 12, wherein said sun gear and said planetary gears, and said support plate are substantially received in a recess defined on a side of said top plate facing said electric motor.

14. An engine starter according to claim 12, wherein a free end of said rotor shaft is pivotally supported in a central recess formed in an opposing end surface of said output shaft.

* * * * *